US009306296B2

(12) United States Patent
Jaschke et al.

(10) Patent No.: US 9,306,296 B2
(45) Date of Patent: Apr. 5, 2016

(54) CONTACTING DEVICE OF AN ELECTRIC PLUG-IN CONNECTOR

(75) Inventors: Stefan Jaschke, Stemwede (DE); Stephan Schreier, Rahden (DE)

(73) Assignee: HARTING ELECTORNICS GMBH, Espelkamp (DE)

( * ) Notice: Subject to any disclaimer, the term of this patent is extended or adjusted under 35 U.S.C. 154(b) by 309 days.

(21) Appl. No.: 13/981,658

(22) PCT Filed: Jan. 26, 2012

(86) PCT No.: PCT/DE2012/100018

§ 371 (c)(1),
(2), (4) Date: Jul. 25, 2013

(87) PCT Pub. No.: WO2012/103883

PCT Pub. Date: Aug. 9, 2012

(65) Prior Publication Data

US 2015/0222028 A1 Aug. 6, 2015

(30) Foreign Application Priority Data

Feb. 2, 2011 (DE) ..... 10 2011 000 460

(51) Int. Cl.

| | |
|---|---|
| ***H01R 4/24*** | (2006.01) |
| ***H01R 24/38*** | (2011.01) |
| ***H01R 13/658*** | (2011.01) |
| *H01R 13/6585* | (2011.01) |

(52) U.S. Cl.

CPC ..... *H01R 4/24* (2013.01); *H01R 4/2433* (2013.01); *H01R 13/658* (2013.01); *H01R 24/38* (2013.01); *H01R 13/6585* (2013.01)

(58) Field of Classification Search

CPC ..... H01R 4/24; H01R 13/658; H01R 24/38; H01R 13/6585; H01R 4/2433

USPC ..... 439/393

See application file for complete search history.

(56) References Cited

U.S. PATENT DOCUMENTS

| | | | | |
|---|---|---|---|---|
| 2,673,968 | A | 3/1954 | Smith | |
| 4,726,785 | A | 2/1988 | Kerboul et al. | |
| 4,737,122 | A | 4/1988 | Dechelette | |
| 6,267,617 | B1 | 7/2001 | Nozick | |
| 6,752,647 | B1 * | 6/2004 | Lin | 439/412 |

(Continued)

FOREIGN PATENT DOCUMENTS

| | | |
|---|---|---|
| DE | 19811667 | 1/2002 |
| FR | 2921522 | 3/2009 |

(Continued)

*Primary Examiner* — Jean F Duverne
(74) *Attorney, Agent, or Firm* — Jacobson Holman, PLLC.

(57) ABSTRACT

The invention relates to a contact-making apparatus for establishing electrical contact between a conductor or a plurality of conductors of a cable which is to be connected and a plug connector, comprising an insulating body which can be inserted into a chamber of a plug connector housing which is provided for this purpose, and at least one pressure piece which is suitable for receiving at least one conductor, wherein the at least one pressure piece is connected to the insulating body in a pivotable and articulated manner, and wherein the insulating body comprises at least one recess which in turn contains at least one insulation-displacement terminal, and wherein the pressure piece can be recessed in the at least one recess in the insulating body, and therefore the insulation-displacement terminal makes electrical contact with the end portion of the conductor.

13 Claims, 3 Drawing Sheets

(56) References Cited

U.S. PATENT DOCUMENTS

Figure 1:
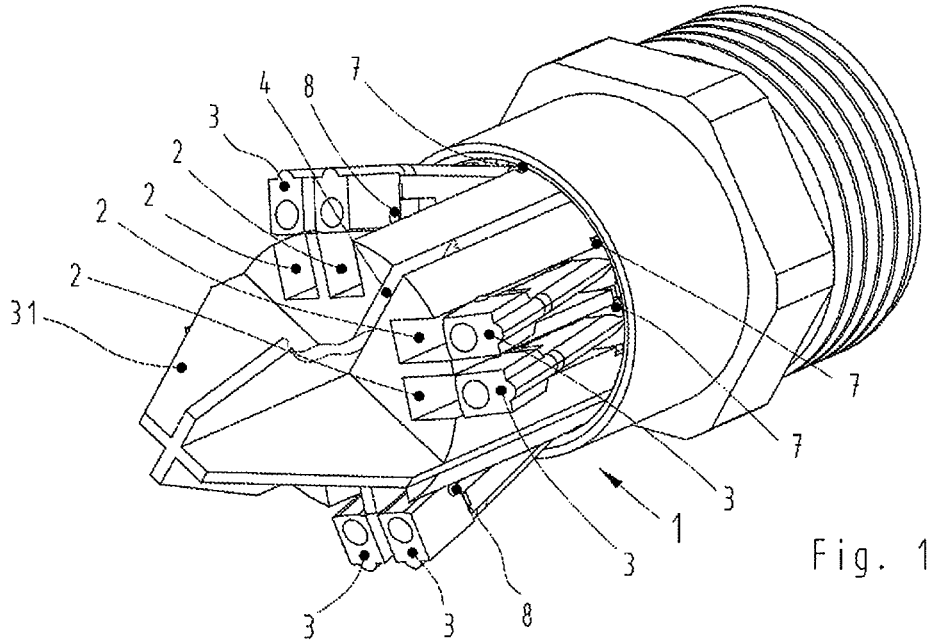

| | | | | |
|---|---|---|---|---|
| 7,850,472 | B2 * | 12/2010 | Friedrich et al. | 439/256 |
| 2001/0044231 | A1 | 11/2001 | Bogdan et al. | |
| 2003/0017740 | A1 * | 1/2003 | Watanabe | 439/393 |

FOREIGN PATENT DOCUMENTS

| | | |
|---|---|---|
| WO | WO 89/08337 | 9/1989 |
| WO | WO 2004/105186 | 12/2004 |

* cited by examiner

CONTACTING DEVICE OF AN ELECTRIC PLUG-IN CONNECTOR

This is a national stage of PCT/DE12/100018 filed Jan. 26, 2012 and published in German, which has a priority of German no. 10 2011 000 460.2 filed Feb. 2, 2011, hereby incorporated by reference.

The invention relates to a contacting device of an electric plug-in connector according to the preamble of claim 1.

A contacting device essentially comprises an insulating body to accept and electrically contact a conductor or several conductors of a cable to be connected, which is inserted into a chamber of a plug-in connector housing provided for this purpose. The insulating bodies of plug-in connectors carry the end sections of cable cores and the contact elements connected thereto.

When the end sections of the cable cores are connected to the contact elements of the insulating body the insulating body can be inserted into a plug-in connector housing provided for this purpose. The plug-in connector housing generally comprises a metallic material.

Such insulating bodies are required to create multi-polar plug-in connectors for analog or digital data transmissions, which can be used in screened embodiments at frequencies up to 600 MHz or even higher.

PRIOR ART

DE 198 11 667 C2 shows an insulating body of an electric plug-in connector. The insulated ends of the conductors of the cable to be connected are inserted into the accepts of the insulating body provided for this purpose. Subsequently the insulating body is inserted into a chamber of a housing half of the plug-in connector. By the screw connection to each other of both housing halves of the plug-in connector the individual cables are inserted into the sections of the insulation displacement terminations, embodied in a fork-like fashion such, that the insulation is cut and the conductors are electrically contacted.

U.S. Pat. No. 4,737,122 shows a cable manager for multi-polar plug-in connectors.

U.S. Pat. No. 6,267,617 B1 shows a contacting device with the individual conductors being inserted into a cap. During the insertion of the cap into a chamber of a plug-in connector housing the individual conductors are impressed into insulation displacement terminations arranged in the plug-in connector housing.

WO 2004/105186 A1 shows an insulating body, at which individual pressure parts are pivotally linked to accept a conductor of a multi-core cable. When the individual conductors are inserted into the accepts of the pressure parts the individual pressure parts are manually impressed into accepts of the insulating body provided for this purpose, which results in an electric contacting of the individual conductors with the insulation displacement terminations included in the recesses.

Such a connecting of the conductors of a cable to a plug-in connector is time consuming, requires high forces and/or special tools. Additionally there is the risk that the ends of the conductors slip during the screw process and thus are contacted only insufficiently.

OBJECTIVE

The objective of the invention is to suggest a contacting device by which the cable cores of a cable can easily and reliably be contacted.

The objective is attained in the characterizing features of claim 1.

Advantageous embodiments of the invention are disclosed in the dependent claims.

One or more pressure part(s) are pivotally arranged at the insulating body according to the invention. The insulating body includes recesses in which in turn insulation displacement terminations are inserted. The pressure parts are provided in order to accept a conductor or several conductors of a cable to be connected. During the insertion of the pressure parts into the recesses at the insulating body the conductor or conductors is/are electrically contacted via the insulation displacement terminations. The insulation displacement terminations can also be replaced by any other contacting means, for example by the so-called piercing technology.

By contacting the cable cores via insulation displacement terminations the cable to be connected can be connected quickly and particularly without any tools to the insulating body of the plug-in connector.

The insulating body can for example be embodied cylindrical or box-shaped.

The insulating body includes recesses in which insulation displacement terminations are clamped in a manner preventing loss.

The insulation displacement terminations are essentially embodied as a U-shaped part. The lateral flanks are extended at both ends of the U-shaped part. At one end the extended flanks are bent towards each other and form a fork-like cutting section. At the other end the extended flanks form an elastic clamping opening to accept an electric plug-in element.

As already mentioned above at least one pressure part is pivotally supported at the insulating body, with the pressure part comprising at least one accept for a cable core, in which the cable core can be clamped.

Advantageously the pressure part is only provided to accept a single conductor so that several such pressure parts are pivotally linked to the insulating body in order to allow connecting multi-core cables. In case of a cylindrical basic body the pressure parts are for example arranged parallel in reference to each other along the jacket area of the cylindrical body.

Advantageously the number of pressure parts is also equivalent to the number of conductors connected to the plug-in connector. This way the conductors in the pressure parts can be pressed with little force into the insulation displacement terminations.

However, pressure parts to accept two or more conductors may also be provided. This is particularly advantageous if the insulating body is embodied box-shaped. The pressure parts are then pivotally linked to the lateral areas of the box.

During the insertion process of the insulating body into a chamber of the plug-in connection housing provided for said purpose the pressure parts are sunk in the allocated recesses of the insulating body, causing the conductor/conductors to be impressed into the fork-like section of the insulation displacement terminations and this way electrically contacted.

In this case, the term sunk means that a large portion of the body of the pressure part vanishes and/or immerses in the recess of the insulating body.

In general the conductors to be connected are embodied in an insulated fashion (by an insulating jacket). The insulation displacement termination cuts through the insulating section and contacts the conductor as described above. By the insulation displacement termination it is also possible to electrically connect non-insulated conductors (without any insulation jacket). Additionally it is irrelevant if bunched conductors or solid conductors shall be connected.

The insertion of the pressure parts into the recesses during the insertion of the insulating body into the chamber occurs without any major force required when the pressure parts are aligned in the axial direction of the insulating body.

The pressure parts can alternatively be impressed manually into the recesses of the insulating body, prior to inserting the insulating body into the plug-in connection chamber. This way the insertion of the insulating body into the plug-in connection chamber is facilitated.

The form of the basic body depends on the chamber of the electric plug-in connector into which the insulating body is inserted after contacting the conductor/conductors. Cylindrical clamps in the plug-in connector housing also require cylindrical insulation bodies. The diameter of the insulating body is here only irrelevantly smaller than the diameter of the cavity of the chamber of the plug-in connector.

Additionally a latching mechanism may be provided so that the insulating body can latch in the chamber of the plug-in connector.

The pressure part essentially comprises a cable core accept and a pivotal arm. The cable core accept is embodied as a box-shaped block which shows an axial bore into which the end of the cable core can be inserted and clamped. The pivotal arm is embodied as an extension of the box-shaped block and shows latching means at its end. The latching means can be latched in a pivotal bearing provided for this purpose inside the recess of the insulating body such that the pressure part is pivotal in the radial direction.

Advantageously the chamber of the plug-in connector housing comprises bars, which divide the chamber into segments of equal size. The bars are made from a conductive material. Advantageously the bars are shaped such that they divide the chamber into four segments of equal size and thus form a so-called screened cross.

In general two conductors are located in a chamber segment so that two pairs of conductors each are electromagnetically shielded from the other pairs of cable cores of the cable. This pair of conductors is also called "twisted pair".

In order to allow inserting the insulating body into the chambers of the plug-in connector, in spite of the bars, the insulating body includes grooves which provide room for the bars. When inserting the insulating body into the chamber the insulating body then cannot be distorted any longer.

It is particularly advantageous for the chamber of the plug-in connector to comprise windows through which the contacted conductor can be observed. This way it can be ensured that the conductor is positioned correctly and has been electrically contacted via the insulation displacement termination.

EXEMPLARY EMBODIMENT

Figure 2:
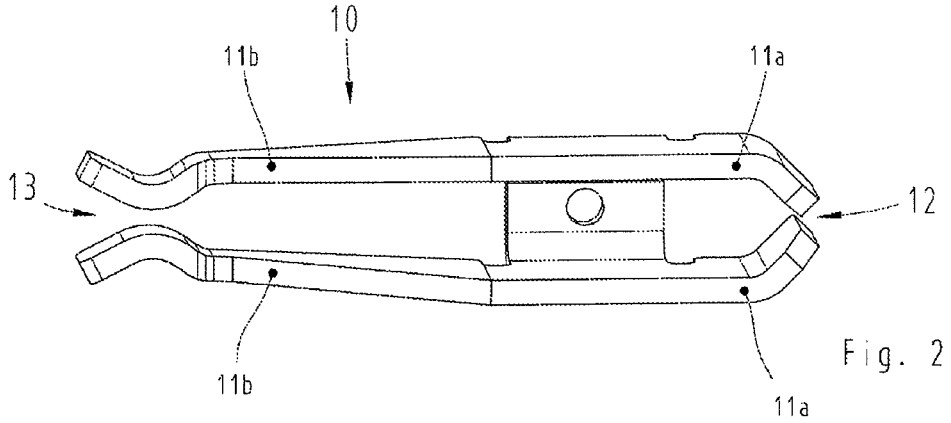
Figure 3:
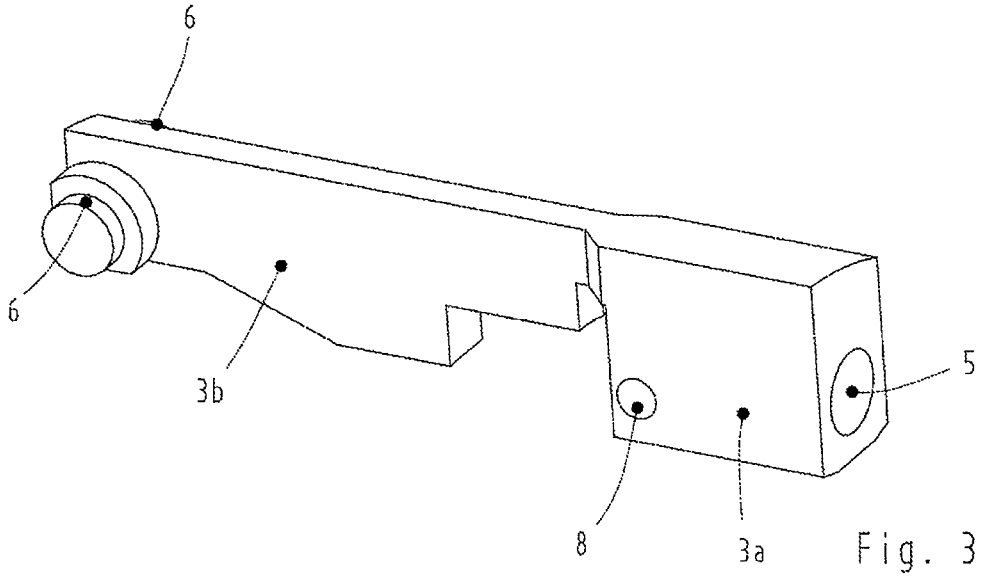
Figure 4:
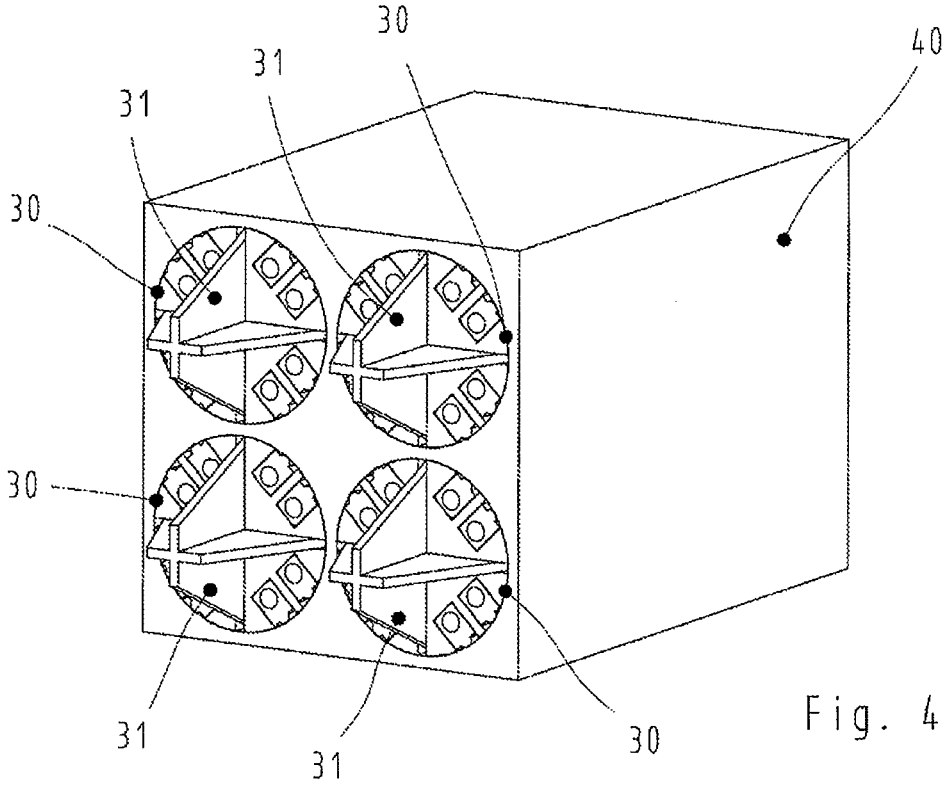
Figure 5:
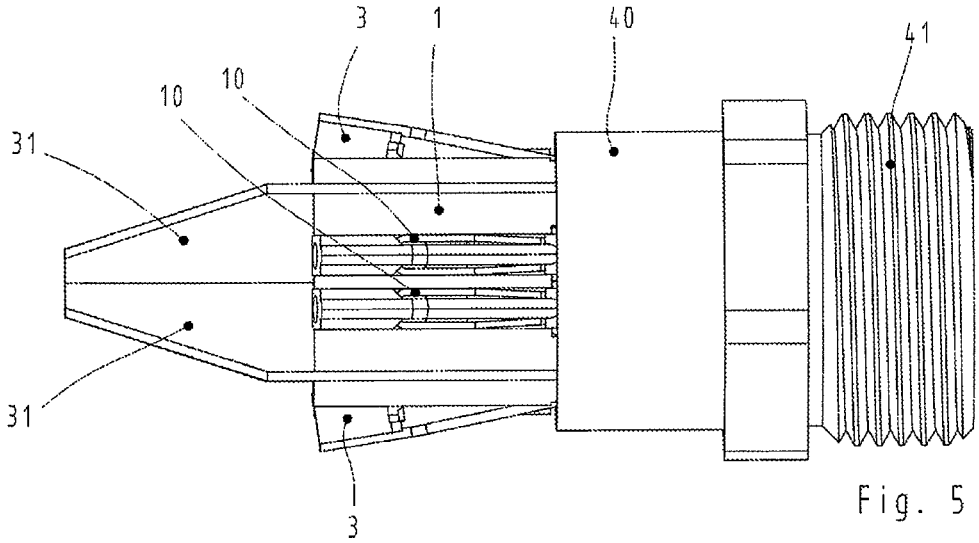

An exemplary embodiment of the invention is shown in the drawings and in the following it is explained in greater detail. It shows:

FIG. 1 a perspective illustration of the insulating body and a chamber of the plug-in connector housing, FIG. 2 a top view of a insulation displacement termination, FIG. 3 a perspective illustration of a pressure part, FIG. 4 a perspective view of the plug-in connector housing with four chambers, FIG. 5 a side view of a part of a plug-in connector housing with a partially inserted insulating body.

Figure 6:
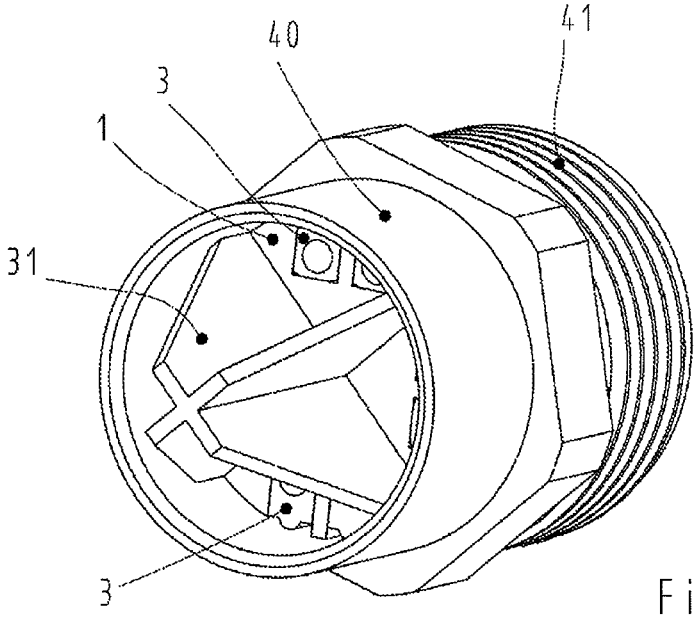

FIG. 6 a perspective illustration of a part of the plug-in connector housing with a completely inserted insulating body.

FIG. 1 shows a perspective illustration of the insulating body 1, which has not yet been inserted into a chamber 30 of a plug-in connection housing provided for this purpose.

The insulating body 1 illustrated in this exemplary embodiment shows essentially the form of two axially connected cylindrical bodies with different diameters. Pressure parts 3 are pivotally fastened along the jacket surface of the insulating body. The pressure parts 3 can be impressed into the recesses 2 in the radial direction. A insulation displacement termination 10 is clamped in each recess 2. The fastening of the insulation displacement termination 10 in the recess 2 can also occur in a different fashion, of course.

The insulation displacement termination 10 is essentially embodied as a U-shaped part. The lateral flanks 11*a*, 11*b* are extended at the two ends of the U-shaped part. At one end the extended flanks 11*a* are bent towards each other and form a fork-like cutting section 12. At the other end the extended flanks form an elastic clamping opening 13 to accept an electric plug-in element. In the exemplary embodiment shown here the connection part of the insulation displacement termination 10 is embodied female. A male embodiment, clamping pin instead of clamping opening 13, is also possible, of course.

FIG. 3 shows a perspective illustration of a pressure part 3. The pressure part 3 comprises a cable core accept 3*a* and a pivotal arm 3*b*.

The cable core accept 3*a* is embodied box-shaped and provided with an axial bore 5. The conductor of a cable to be connected (not shown) is inserted into the bore 5 and clamped. The clamping occurs for example via clamping ribs located at the inside, not shown here.

The pivotal arm 3*b* is also embodied in a box-shaped fashion and formed as an extension at the cable core accept 3*a*. A bar-bell shaped latching means 6 is formed at the end of the pivotal arm 3*b*. The latching means 6 is latched in a pivotal bearing 7 provided for this purpose such that the pressure part 3 can be pivoted towards or away from the axis of the insulating body 1. At the narrow sides of the box-shaped cable accept 3*a* fastening pins 8 are each formed. The respective pressure part 3 can be impressed via fastening pins 8 in two different latching positions in the insulating body 1. The first latching position is predetermined by the fastening pins 8. When the pressure part 3 with the fastening pin 8 is inserted in the insulating body 1 the fastening pins 8 at both sides latch with the undercuts provided for this purpose (not shown) in the insulating body 1. The pressure part 3 is not yet entirely inserted into the insulating body 1, but held latched in a first latching position. Only upon a further impression of the pressure part 3 into the insulating body the pressure part 3 is entirely inserted therein and latched.

Electric contacting of the conductor/the conductors at the insulating body 1:

The conductors of the cable to be connected are successively inserted into the individual pressure parts 3 of the insulating body 1. The pressure parts 3 may show different colors, for example the same color as the insulating jacket of the respective conductor. This way any false connection of the cable to the plug-in connector is prevented.

Now the pressure parts 3 can be inserted into the insulating body 1 up to the first latching position. The pressure parts 3 latch in this position via the fastening bars 8. Simultaneously the conductors rest in the upper cutting section 12 of the insulation displacement terminations 10 and cannot slip any more.

This way the insulating body 1 can be inserted into the clamp 30 of the plug-in connector housing. The chamber 30 is embodied such that the pressure part 3 can be impressed through the chamber wall into the recesses 2 when the insulating body 1 is inserted into the chamber 30. The insulation displacement termination 10 embedded in the respective recess 2 severs the core insulation (insulation jacket) of the conductor and contacts it electrically.

Alternatively the pressure parts with inserted conductors can also be manually pressed into the second latching position before the insulating body 1 is inserted into the chamber 30. This is particularly useful when a plurality of conductors must be connected. Here, the forces for insertion into the chamber 30 would be excessive otherwise.

When inserting the insulating body 1 into the chamber 30 the bars 31 of the chamber 30 located at the inside are guided into the grooves 4 of the insulating body 1 provided for this purpose. FIG. 1 shows a portion of the bar 31 broken off, in order to render the groove 4 better visible.

In the exemplary embodiment shown here the chamber 30 is divided by the bars 31 into four segments. Each segments houses 2 conductors each of the cable to be connected. The bars are made from a metallic material and electromagnetically shield the individual pairs of cable cores from each other. The bars form a so-called shielding cross.

In the exemplary embodiment shown here the insulating body 1 can accept eight conductors. However, variants with 12 or more conductors are also possible. In these cases the chamber 30 would be segmented differently by the bars 31. Accordingly more bars 31 would be present.

FIG. 4 shows a perspective illustration of a plug-in connector housing with four chambers 30. An insulating body 1 can be inserted into each chamber 30. This exemplary embodiment shall illustrate the modular design of the contacting of the conductors according to the invention and the connection process of a cable to the plug-in connector.

It is possible to connected only one conductor to an insulating body 1. Up to 12 conductors per insulating body are also quite possible. Simultaneously it is also possible to equip the plug-in connector housing with up to 12 chambers.

FIG. 5 shows a side view of a part of a plug-in connector housing 40. The insulating body 1 is inserted half way into the chamber 30 of the plug-in connector housing 40. At the connector side the plug-in connector housing is provided with a thread 41. The bars 31 of the shielding cross are also discernible. The pressure parts are inserted beyond the fastening pins 8 into the insulating body 1 and thus latched in a first position. Now the insulating body 1 can be inserted further into the chamber 30 of the plug-in connector housing 40, causing the conductors (not shown here) to be electrically contacted via insulation displacement terminations 10.

FIG. 6 shows a perspective view of the plug-in connector housing of FIG. 5 with a completely inserted insulating body 1. It is clearly discernible from this figure that the chamber 30 of the plug-in connector housing 40 is divided by the bars 31 into four segments of equal size, each housing two conductors of the cable to be connected.

LIST OF REFERENCE CHARACTERS

1 Insulating body
2 Recess
3 Pressure part
3*a* Cable core accept
3*b* Pivotal arm
4 Groove
5
6 Latching means
7 Pivotal bearing
8 Fastening pins
10 Insulation displacement termination
11 *a, b* lateral flank
12 Cutting section
13 Clamping opening
30 Chamber
31 Bar
40 Plug-in connector housing
41 Thread

The invention claimed is:

1. A contacting device for the electric contacting of one conductor or several conductors of a cable to be connected to a plug-in connector, comprising an insulating body (1), which can be inserted into a chamber (30) of a plug-in connector housing (40) provided for this purpose, at least one pressure part (3), which is suitable to accept at least one conductor, with at least one pressure part (3) being pivotally linked to the insulating body (1), and at least one contacting means (10) for an electric contacting of an end section of a conductor, with the insulating body (1) comprising at least one recess (2), which includes said at least one contacting means (10), and wherein said at least one pressure part is pivotally linked to said insulating body adjacent said at least one recess, wherein the pressure part (3) can be pivotally moved by insertion of the insulating body (1) into the chamber (30) so as to sink the pressure part in at least one recess (2) of the insulating body (1), so that the end section of a conductor that is accepted in the pressure part can be electrically contacted by the contacting means (10).

2. A contacting device according to claim 1,
characterized in that
the contacting means is an insulation displacement termination (10).

3. A contacting device according to claim 1,
characterized in that
the insulating body (1) comprises grooves (4), into which bars (31) can be inserted, extending inside the chamber (30) of the plug-in connector housing, with the bars (31) mutually shielding in an electromagnetically fashion pairs of conductors of a cable to be connected.

4. A contacting device according to claim 1,
characterized in that
the pressure part (3) comprises a cable core accept (3*a*) and a pivotal arm (3*b*).

5. A contacting device according to claim 1,
characterized in that
the insulating body (1) is cylindrical.

6. A contacting device according to claim 1,
characterized in that
the insulating body (1) is box-shaped.

7. A contacting device according to claim 1,
characterized in that
at least one pressure part (3) is aligned in the axial direction of the insulating body (1).

8. A contacting device according to claim 1,
characterized in that
at least one pressure part (3) can be latched via fastening pins (8) in a first latching position in the insulating body (1).

9. A contacting device according to claim 8,
characterized in that
in a second latching position the pressure part (3) can be latched entirely inside the insulating body (1).

10. A connecting device for electrically connecting conductors of a cable to a plug-in connector, said plug-in connector including a plug-in connector housing having at least one axially extending chamber therein, said connecting device comprising, an axially extending insulating body insertable in an axial direction into a chamber of a plug-in connector housing, said insulating body including at least one axially extending recess that includes an electrical contact for electrically contacting a cable conductor, said insulating body further including at least one elongated pressure part having one end including an opening for receiving a cable conductor and an opposite end having a pivotable connection for pivotally connecting said pressure part to said insulating body, said pressure part including a pivot arm extending between said one end and said opposite end, each said pressure part overlying a recess, said pressure part pivotal from an angled position above said recess into an axially oriented position within said recess and into engagement with said electrical contact to enable a cable conductor that is received within the pressure part to engage the electrical contact, wherein said pivot arm is engageable with the plug-in connector housing to pivot the pressure arm from an angled position above said recess into an axially oriented position within said recess as said insulating body is inserted into the chamber of the plug-in connector housing.

11. The connecting device of claim 10, wherein said electrical contact comprises an insulation displacement termination means for severing an insulation jacket of a cable conductor when said pivot part is inserted within said recess of the insulating body.

12. The connecting device of claim 11, wherein said insulating body includes grooves for aligning the insulating body with said chamber of the plug-in connector housing.

13. The connecting device of claim 11, wherein said pressure part includes a fastening pin for latching said pressure part in a first angled position and for latching said pressure part in a second axially oriented position entirely within said recess.

* * * * *